US009373442B2

(12) United States Patent
Albrecht et al.

(10) Patent No.: US 9,373,442 B2
(45) Date of Patent: Jun. 21, 2016

(54) ON-LOAD TAP CHANGER

(75) Inventors: Wolfgang Albrecht, Wenzenbach (DE); Christian Hammer, Regensburg (DE); Christian Kotz, Schorndorf (DE); Sebastian Rehkopf, Regensburg (DE); Andreas Sachsenhausen, Mallersdorf-Pfaffenberg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 474 days.

(21) Appl. No.: 13/642,141

(22) PCT Filed: Feb. 23, 2011

(86) PCT No.: PCT/EP2011/000859
§ 371 (c)(1),
(2), (4) Date: Nov. 9, 2012

(87) PCT Pub. No.: WO2011/141081
PCT Pub. Date: Nov. 17, 2011

(65) Prior Publication Data

US 2013/0057248 A1 Mar. 7, 2013

(30) Foreign Application Priority Data

May 8, 2010 (DE) ..... 10 2010 019 948

(51) Int. Cl.
*G05F 1/14* (2006.01)
*H01F 29/04* (2006.01)
*H01H 9/00* (2006.01)

(52) U.S. Cl.
CPC *H01F 29/04* (2013.01); *G05F 1/14* (2013.01); *H01H 9/0038* (2013.01)

(58) Field of Classification Search
USPC ..... 323/255–258, 340–343
See application file for complete search history.

(56) References Cited

U.S. PATENT DOCUMENTS 3,039,041 A * 6/1962 Jansen ..... H01F 29/04 323/340
3,934,174 A 1/1976 Bleibtreu
3,935,407 A * 1/1976 Bleibtreu et al. ..... 218/2

FOREIGN PATENT DOCUMENTS

DE 2021575 A 12/1971
DE 2604344 A 8/1977
JP 02216805 A * 8/1990
WO WO 0231846 A1 * 4/2002

* cited by examiner

*Primary Examiner* — Harry Behm
(74) *Attorney, Agent, or Firm* — Andrew Wilford

(57) ABSTRACT

The invention relates to an on-load tap changer for step transformers, which has one main current branch and one auxiliary current branch for each of the two winding taps to be switched. In each main current branch and auxiliary current branch, switching is accomplished by means of a vacuum switching tube. According to the invention, an additional mechanical contact is provided in each of the main current branches and in each of the auxiliary current branches between the respective winding tap to which said branch is electrically connected and the respective vacuum switching tube in said branch. Said mechanical contacts are switched in such a way that the vacuum switching tubes in the main current branch and the auxiliary current branch of the unconnected winding tap can be galvanically isolated from the unconnected winding tap.

8 Claims, 7 Drawing Sheets

ON-LOAD TAP CHANGER

CROSS REFERENCE TO RELATED APPLICATIONS

This application is the US-national stage of PCT application PCT/EP2011/000859 filed 23 Feb. 2011, published 17 Nov. 2011 as WO2011/141081, and claiming the priority of German patent application 102010019948.6 itself filed 8 May 2010.

FIELD OF THE INVENTION

The invention relates to an on-load tap changer for uninterrupted switching over between winding taps of a tapped transformer having a selector for power-free preselection of the winding tap that is to be switched to and a load changeover switch for the actual load changeover from the previous winding tap to the preselected winding tap.

BACKGROUND OF THE INVENTION

Such a known load changeover switch typically has two main current branches and two auxiliary current branches. The first main current branch electrically connects the first winding tap to a load shunt via a vacuum switching tube, the second main load branch electrically connects the second winding tap to the load shunt via a further vacuum switching tube, the first auxiliary current branch connects the first winding tap to the load shunt via a series connection of a further vacuum switching tube and at least one switch-over resistance, and the second auxiliary current branch connects the second winding tap to the load shunt via a series connection of a further vacuum switching tube and at least one further switch-over resistance.

Such a load changeover switch having in total four vacuum switching tubes per phase is known from DE 2021575 A. A respective vacuum switching tube as main contact and a respective further vacuum switching tube that is in series connection with a switch-over resistance, as resistance contact are provided in each of the two load branches respectively connected with a winding tap. In a case of uninterrupted load changeover from the previous winding tap n to the new, preselected winding tap n+1 initially the main contact of the side being switched off is opened and thereupon the resistance contact of the side taking over closes so that a compensating current limited by the switchover resistors flows between the two winding taps n and n+1. After the previously closed resistance contact of the side switching off has opened, the main contact of the side taking over then closes so that the entire load current leads from the new winding tap n+1 to the load shunt; the changeover is thus concluded.

However, in different cases of use of such known on-load tap changers with vacuum switching tubes for regulation of power transformers a high surge-voltage strength of up to 100 kV and significantly above that is required. Such undesired surge voltages, the level of which is substantially dependent on the construction of the tapped transformer and the winding parts between the individual tap steps, are on the one hand lightning surge voltages that result from lightning strikes in the mains. On the other hand, switching surge voltages can also occur that are caused by unpredictable switching surges in the mains to be regulated. In the case of insufficient surge-voltage strength of the on-load tap changer a transient step short-circuit or undesired disruption of the ceramic or the damping screen of vacuum switching tubes in the load branch not conducting the load current can occur, which not only can cause long-term damage thereof, but is generally undesirable.

In order to combat excessive surge-voltage loads it is already known from DE 2357209 [U.S. Pat. No. 3,934,174] and DE 2604344 to provide protective spark gaps or voltage-dependent resistors or both between the load branches; however, these means are, in various cases, insufficient and are unable to exclude or completely exclude harmful surge voltage loads in their effect.

OBJECT OF THE INVENTION

The object of the invention is to indicate an on-load tap changer of the kind stated in the introduction with high surge-voltage strength and at the same time high switching power.

SUMMARY OF THE INVENTION

This object is fulfilled by an on-load tap changer in which a further, separately actuatable mechanical contact is provided in each of the two main current branches and in each of the two auxiliary current branches between the respective winding tap and the respective vacuum switching tube such that the vacuum switching tubes in the main current branch and the vacuum switching tubes in the auxiliary current branch of the unconnected winding tap are electrically separable from this tap.

The invention is based on the general idea of achieving an electrical separation, i.e. separation of potential, of the vacuum switching tubes in the respective branch that is not conducting load current from the respective winding tap by additional mechanical switching elements that are respectively arranged between the vacuum switching tubes and the respective winding tap with which they are electrically connected. Possibly occurring surge voltages are thereby harmless to the vacuum switching tubes in each load branch not conducting the load current. This applies equally to vacuum switching tubes operating as a main contact as well as those operating as a resistance contact.

BRIEF DESCRIPTION OF THE DRAWING

The invention shall be explained in more detail in the following by way of example with reference to drawings in which.

SPECIFIC DESCRIPTION OF THE INVENTION

Figure 1:
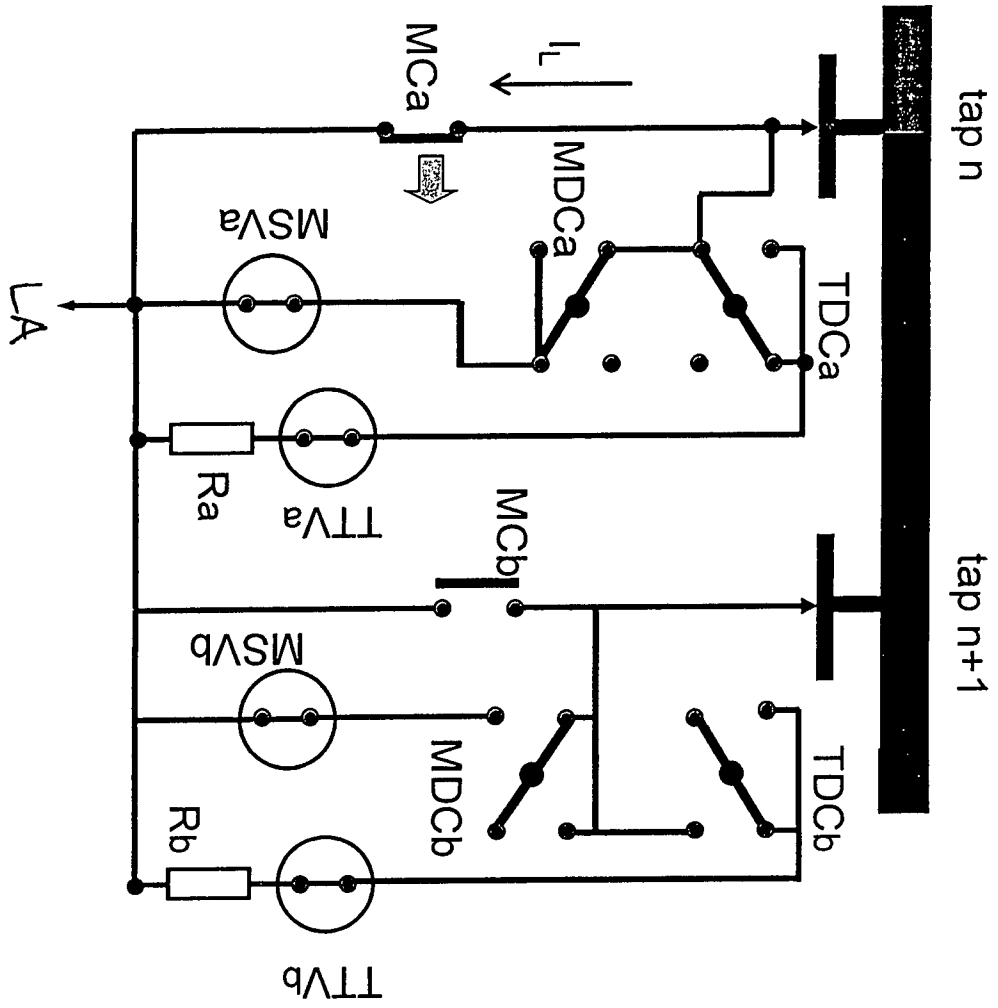
FIG. 1 shows an on-load tap changer according to the invention in schematic illustration in which the basic setting in which the winding tap n is connected is shown.

The load changeover switch of an on-load tap changer according to the invention is illustrated in detail in FIG. 1. The selector of the on-load tap changer that prior to the actual load changeover undertakes power-free selection of the new winding tap—here n+1—that is to be switched over to is not illustrated.

The on-load changeover switch has, as also known from the prior art, two load branches A and B that are respectively electrically connected with a winding tap n or n+1. The on-load tap changer according to the invention has a main current branch and a resistance current branch in each load branch.

The first main current branch produces an electrical connection from the winding tap n to the load shunt LA through a vacuum switching tube MSVa. The second main current branch produces an electrical connection from the winding tap n+1 to the load shunt LA through a vacuum switching tube MSVb. The first auxiliary current branch that is provided in parallel with the first main current branch produces an electrical connection from the winding tap n to the load shunt through a further switching tube TTVa and at least one first switch-over resistance Ra arranged in series therewith. The second auxiliary current branch that is provided in parallel with the second main current branch produces an electrical connection from the winding tap n+1 to the load shunt through a further switching tube TTVb and at least one second switch-over resistance Rb arranged in series therewith.

According to the invention, a further, separately actuatable mechanical contact is provided in each of the main current branches and in each of the auxiliary branches between the respective winding tap n or n+1 and the respective vacuum switching tube MSVa, TTVa—or on the other side, MSVb, TTVb—electrically connected therewith. Thus, in total four such mechanical contacts are present:

- a mechanical contact MDCa for protection of the vacuum switching tube MSVa,
- a further mechanical contact TDCa for protection of the vacuum switching tube TTVa,
- a further mechanical contact MDCb for protection of the vacuum switching tube MSVb and
- finally a further mechanical contact TDCb for protection of the vacuum switching tube TTVb.

In FIG. 1 the respective mechanical contacts MDCa, TDCa, MDCb and TDCb are double-pole switch-over contacts (reversing contacts). However, they can equally well be realized as separate contacts providing simple interruption.

According to a preferred form of embodiment of the invention, additionally provided in each load branch, as also illustrated in FIG. 1, are mechanical permanent main contacts MCa and MCb of which in stationary operation a respective one takes over conducting the permanent main current and relieves the vacuum switching tube in the main current branch of this load branch.

In FIG. 1, the winding tap n is connected; the load current is conducted from this winding tap to the load shunt LA. It can be seen that through the mechanical contact MDCb arranged in accordance with the invention the vacuum switching tube MSVb is in the setting of the mechanical contact completely separated from the unconnected winding tap n+1. Equally, through the setting of the mechanical contact TDCb according to the invention the vacuum switching tube TTVb is completely separated from the unconnected winding tap n+1.

The on-load tap changer according to the invention thus makes it possible to completely electrically separate the vacuum switching tubes in the respective branch that is not conducting load current from the respective winding tap and thus to provide protection from surge-voltage loads.

A complete switching sequence of the on-load tap changer according to the invention in the case of switching-over of the basic setting shown in FIG. 1 to the new winding tap n+1 shall be illustrated in all individual steps in the following by way of the further figures.

Figure 2:
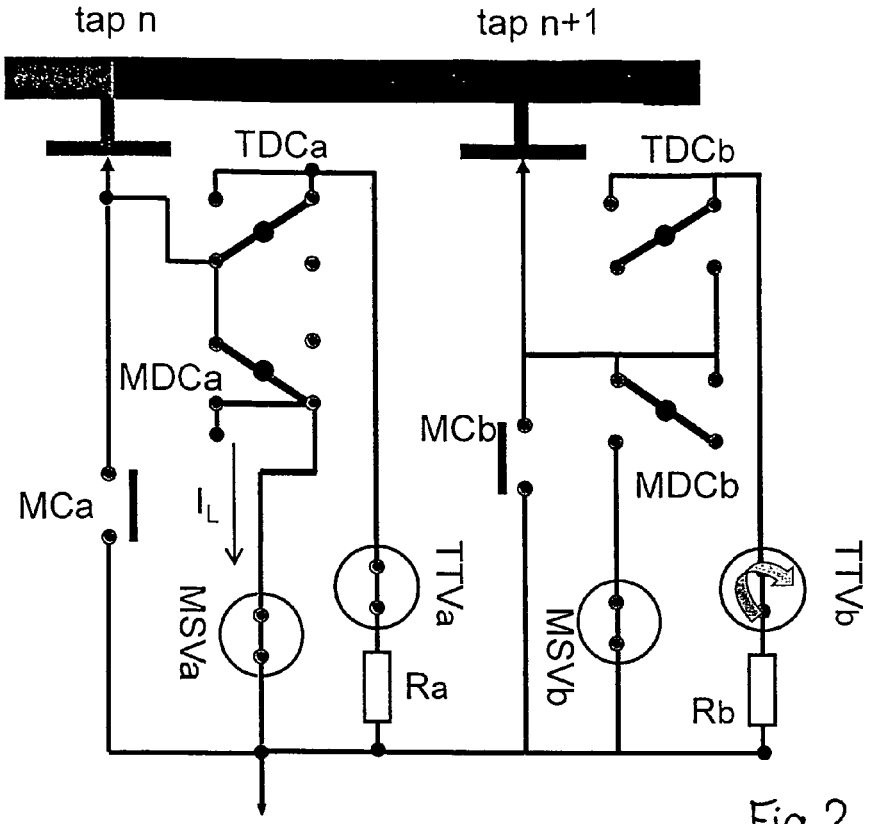
FIGS. 2 to 13 show the individual steps of the changeover sequence in the case of a load changeover to the winding tap n+1, FIG. 13 showing the stationary state after completed load changeover.

FIG. 2: The permanent main contact MCA is open; the load current is taken over by the vacuum switching tube MSVa. The vacuum switching tube TTVb opens at the same time.

Figure 3:
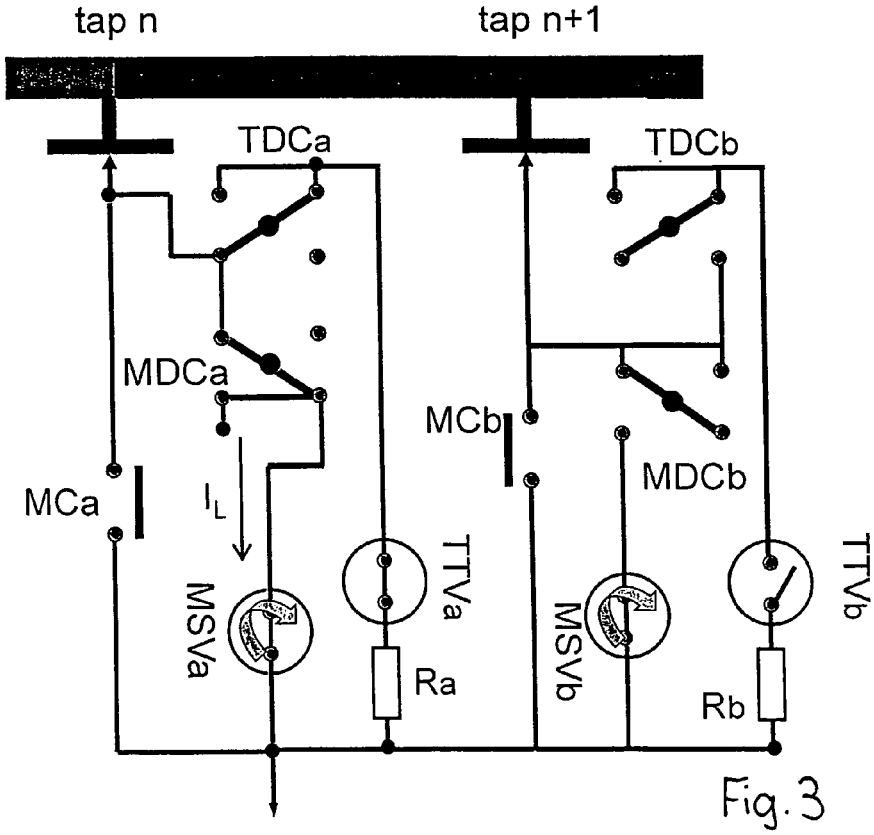

FIG. 3: The vacuum switching tube MSVa opens; the vacuum switching tube MSVb similarly opens.

Figure 4:
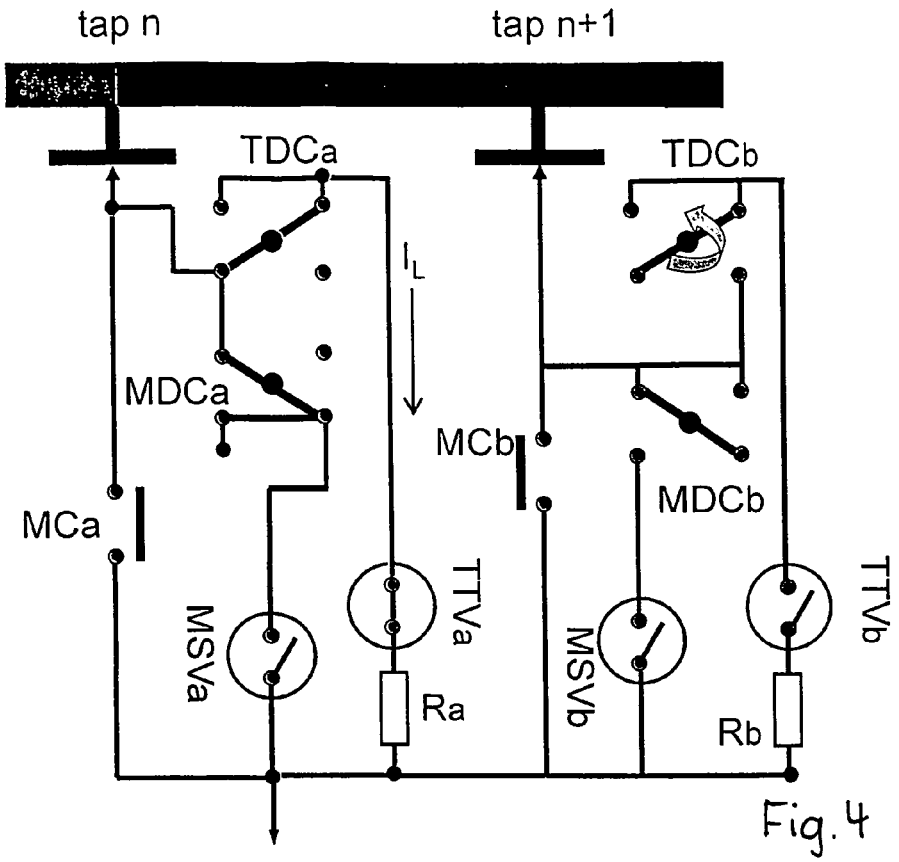

FIG. 4: The load current is now conducted by the vacuum switching tube TTVa and the switch-over resistance RA connected in series. At the same time, the previously open mechanical contact TDCb closes.

Figure 5:
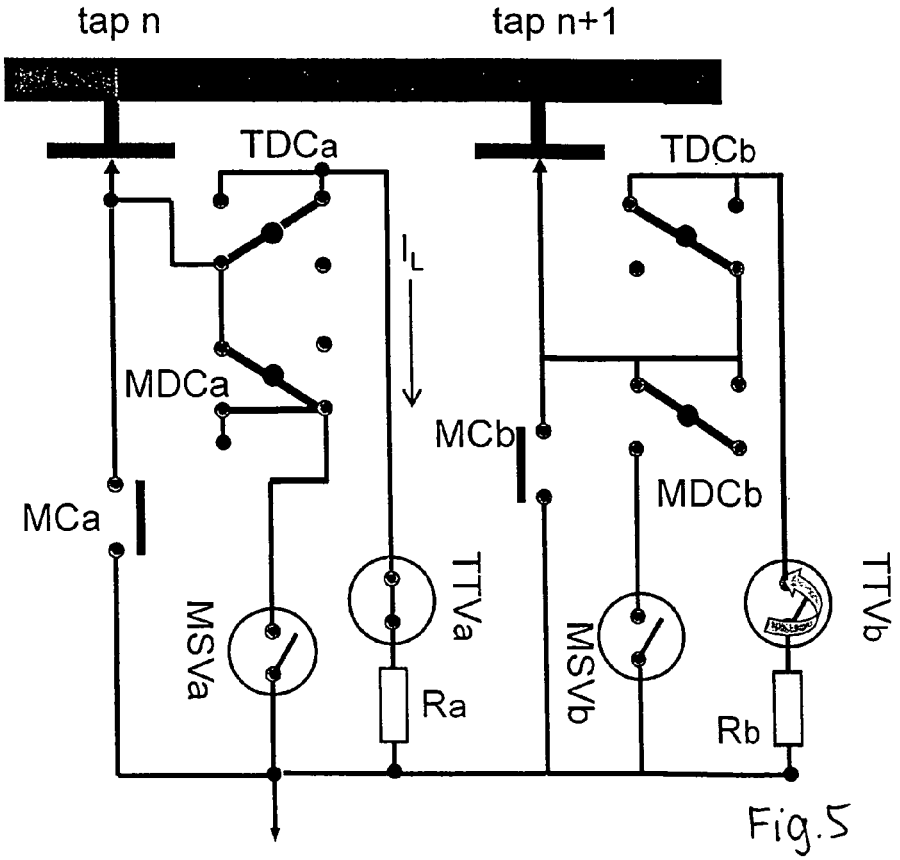

FIG. 5: The vacuum switching tube TTVb closes.

Figure 6:
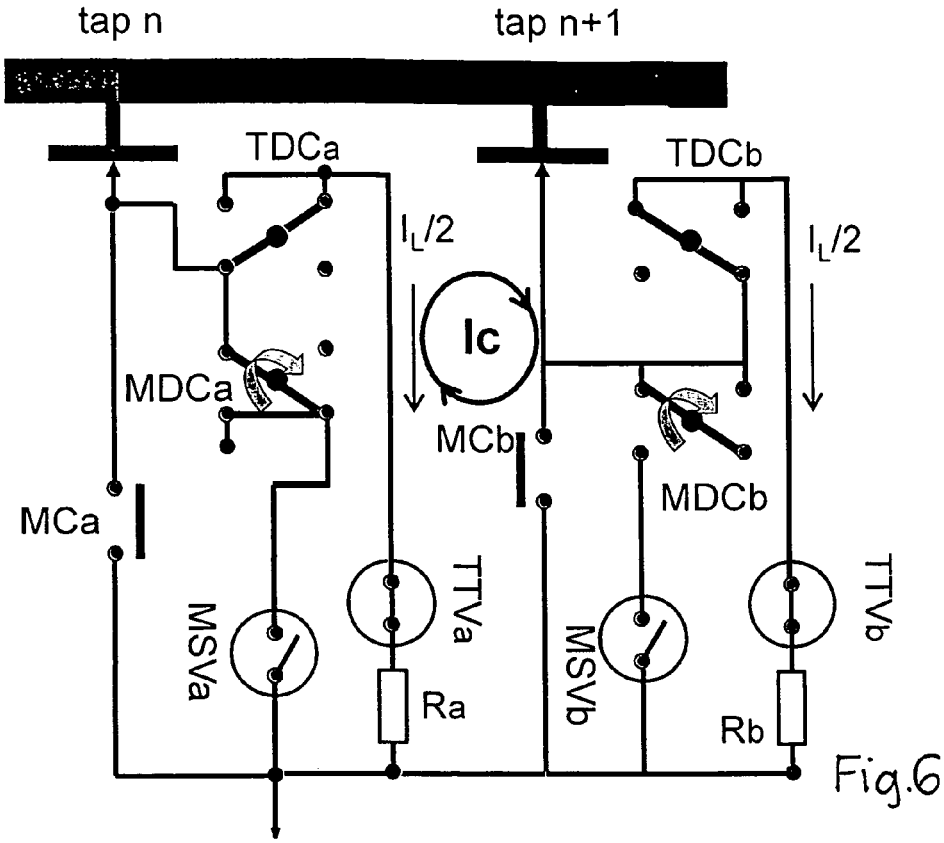

FIG. 6: A circular current now flows through the two vacuum switching tubes TTVa and TTVb and switch-over resistors RA and RB in each of the two branches. At the same time, the mechanical contact MDCa beings to open. The mechanical contact MDCb on the other side begins to close.

Figure 7:
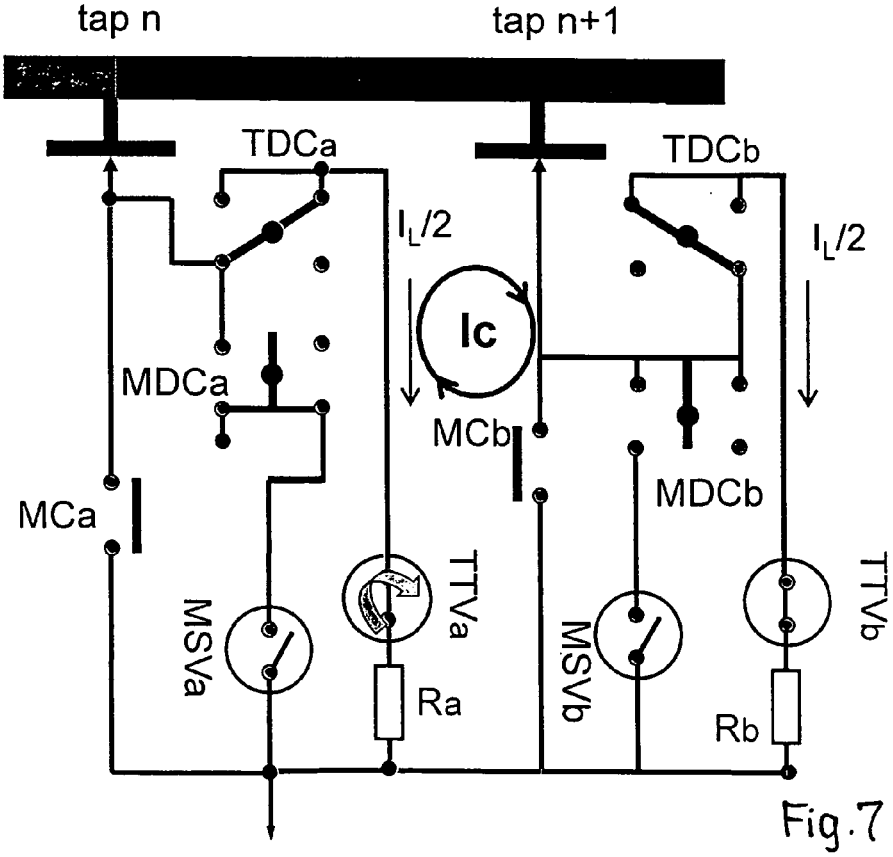

FIG. 7: The vacuum switching tube TTVa now opens.

Figure 8:
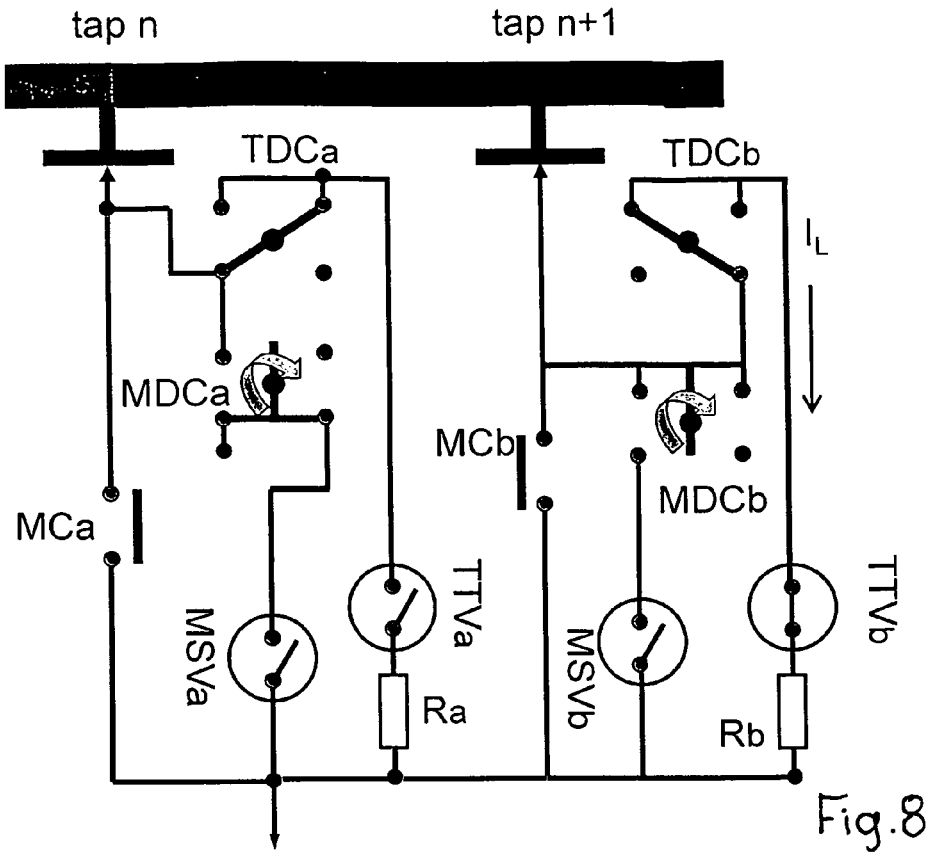

FIG. 8: The load current is now completely commutated to the other branch and is conducted exclusively through the series circuit of TTVb and RB.

Figure 9:
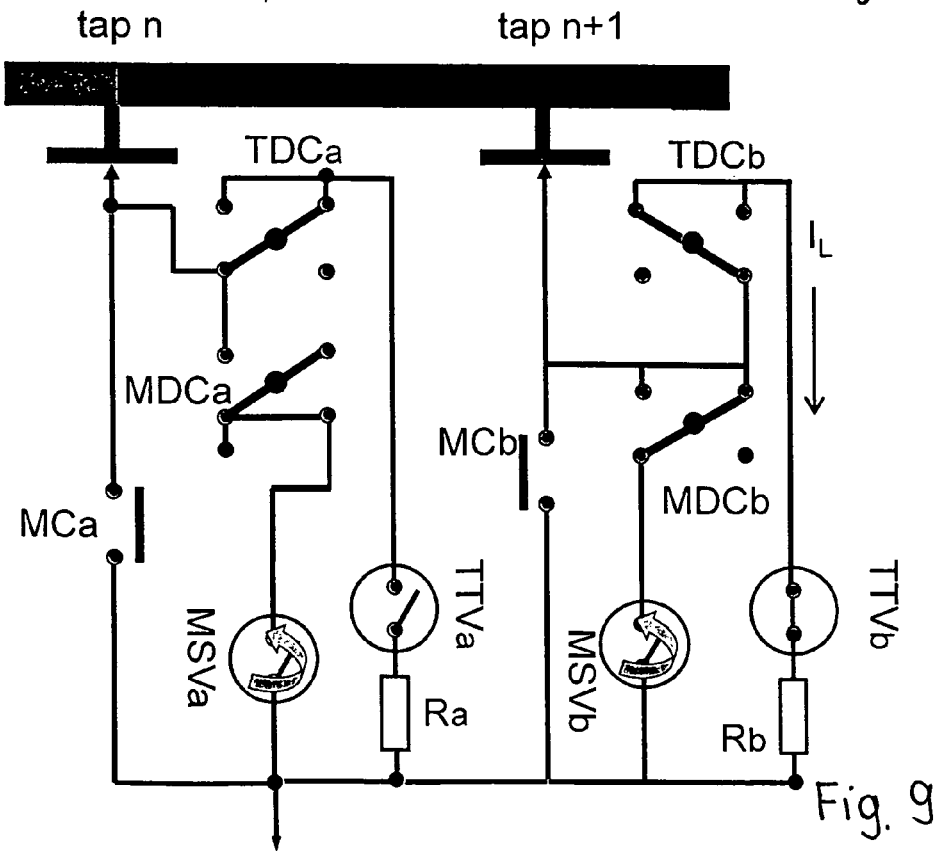

FIG. 9: The mechanical contact MDCa is completely open. The mechanical contact MDCb is completely closed. At the same time, the vacuum switching tubes MSVa and MSVb close.

Figure 10:
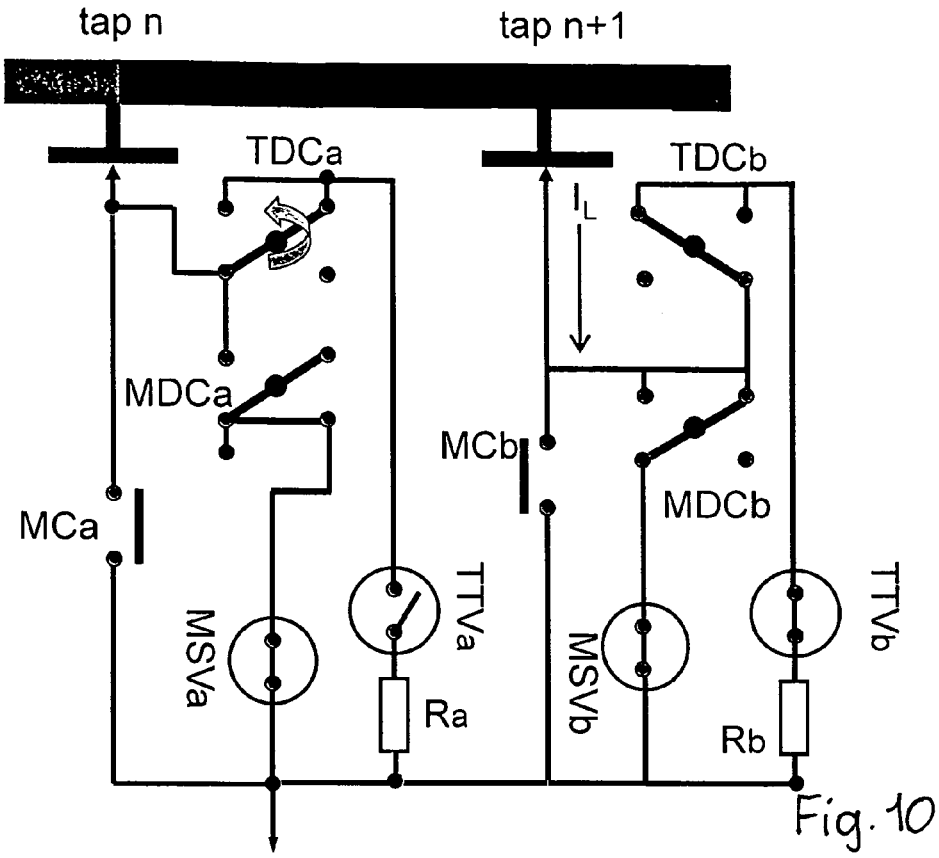

FIG. 10: The load current is now conducted by the vacuum switching tube MSVb. At the same time, the mechanical contact TDCa opens.

Figure 11:
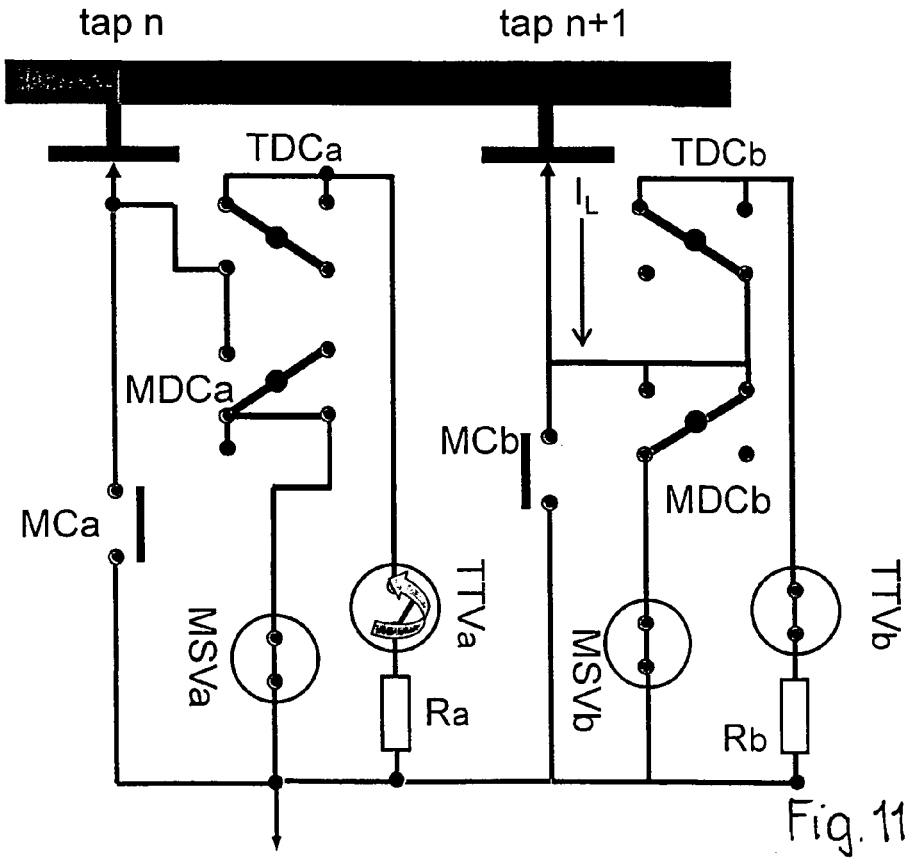

FIG. 11: The vacuum switching tube TTVa closes.

Figure 12:
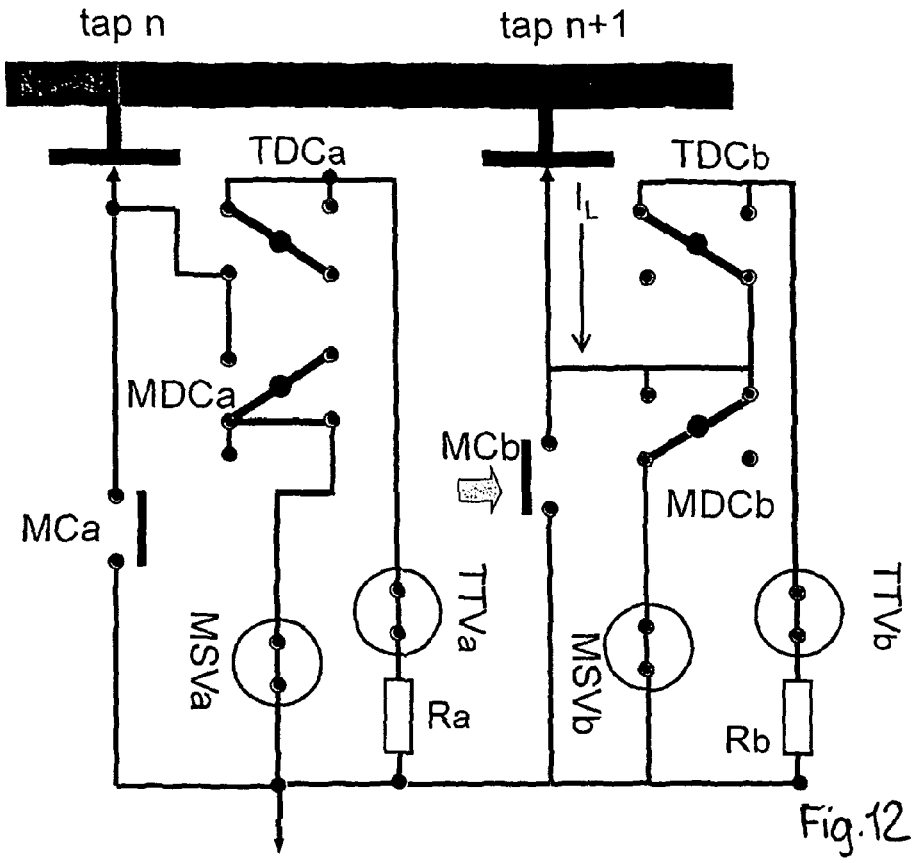

FIG. 12: Through the opened mechanical contacts MDCa and TDCa the vacuum switching tubes on the side MSVa or TTVa not conducting load current are now completely electrically separated from the potential of the previously connected winding tap n.

Figure 13:
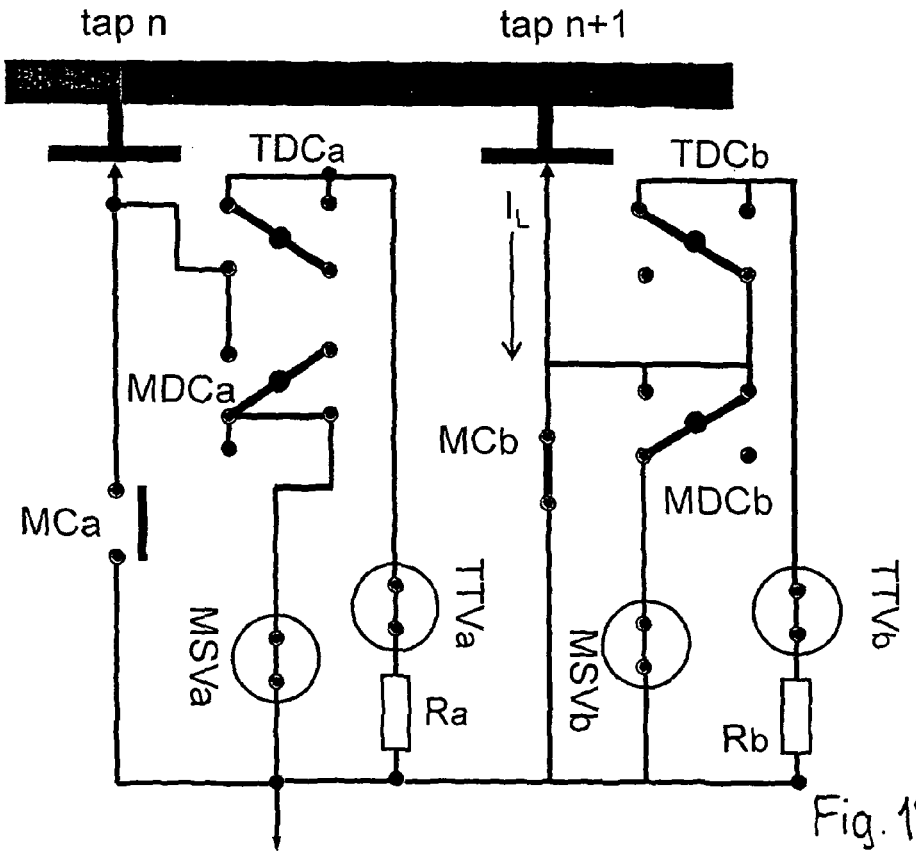

FIG. 13: Finally, the permanent main contact of the newly connected side MCB takes over the load current; the load changeover to the new winding tap n+1 is concluded.

It can be seen that in the case of the explained switching sequence it is ensured that in each instance the vacuum switching tubes of the side not conducting load current are completely electrically separated from the unconnected winding tap by the corresponding mechanical contacts; the object of the invention is fulfilled.

The invention claimed is:

1. An on-load tap changer for uninterrupted switching between winding taps of a tapped transformer, the tap changer comprising:

- a selector for power-free preselection of the winding tap to be switched to;
- a load changeover switch for the actual load changeover from the previous winding tap to the preselected winding tap, the load changeover switch having:
  - a first main current branch that electrically connects the first winding tap to a load shunt through a first vacuum switching tube,
  - a second main current branch that electrically connects the second winding tap to the load shunt through a second vacuum switching tube,
  - a first auxiliary current branch that connects the first winding tap to the load shunt through a series connection of a third vacuum switching tube and at least one first switching resistor, and
  - a second auxiliary current branch that connects the second winding tap to the load shunt through a series connection of a fourth vacuum switching tube and at least one second switching resistor, and
- a first separately actuatable mechanical contact in the first main current branch between the first winding tap and the first vacuum switching tube and having a first movable contact member;
- a second separately actuatable mechanical contact in the second main current branch between the second winding tap and the second vacuum switching tube and having a second movable contact member;

a third separately actuatable mechanical contact in the first auxiliary current branch between the first winding tap and the third vacuum switching tube and having a third movable contact member;

a fourth separately actuatable mechanical contact in the second auxiliary current branch between the second winding tap and the fourth vacuum switching tube and having a fourth movable contact member, whereby the vacuum switching tubes in the main current branch and the vacuum switching tubes in the auxiliary current branch of the unconnected winding tap are electrically separable from the unconnected winding tap.

2. The on-load tap changer defined in claim 1, wherein a permanent main contact for conducting permanent current in stationary operation is provided in parallel to each of the two main current branches.

3. The on-load tap changer defined in claim 1, wherein the mechanical contacts are double-pole changeover contacts.

4. The on-load tap changer defined in claim 1, wherein the mechanical contacts of each branch are constructionally combined.

5. The on-load tap changer defined in claim 1, wherein the selector has:

a first selector contact, and a second selector contact.

6. The on-load tap changer defined in claim 1, wherein:

the first auxiliary current branch is parallel to the first main current branch; and/or the second auxiliary current branch is parallel to the second main current branch.

7. An on-load tap changer for uninterrupted switching between winding taps of a tapped transformer, the tap changer comprising:

a selector for power-free preselection of the winding tap to be switched to, the selector comprising:

a first selector contact, and a second selector contact;

a load changeover switch for the actual load changeover from the previous winding tap to the preselected winding tap, the load changeover switch having:

a first main current branch that electrically connects the first winding tap to a load shunt through a vacuum switching tube;

a second main current branch that electrically connects the second winding tap to the load shunt through a further vacuum switching tube;

a first auxiliary current branch parallel to the first main current branch and connecting the first winding tap to the load shunt through a series connection of a further vacuum switching tube and at least one switching resistor;

a second auxiliary current branch parallel to the second main current branch and connecting the second winding tap to the load shunt through a series connection of a further vacuum switching tube and at least one further switching resistor; and a respective further separately actuatable mechanical contact in each of the main current branches and each of the auxiliary current branches between the respective winding tap and the respective vacuum switching tube thereof such that the vacuum switching tubes in the main current branch and the vacuum switching tubes in the auxiliary current branch of the unconnected winding tap are electrically separable from the unconnected tap, each mechanical contact having a respective movable contact member.

8. An on-load tap changer for uninterrupted switching over between winding taps of a tapped transformer, the tap changer comprising:

a selector for power-free preselection of the winding tap to be switched to;

a load changeover switch for the actual load changeover from the previous winding tap to the preselected winding tap, the load changeover switch having:

a first main current branch that electrically connects the first winding tap to a load shunt through a first vacuum switching tube;

a second main current branch that electrically connects the second winding tap to the load shunt through a second vacuum switching tube;

a first auxiliary current branch that connects the first winding tap to the load shunt through a series connection of a third vacuum switching tube and at least one first switch-over resistance; and a second auxiliary current branch that connects the second winding tap to the load shunt through a series connection of a fourth vacuum switching tube and at least one second switch-over resistance; and a first separately actuatable mechanical contact in the first main current branch between the first winding tap and the first vacuum switching tube;

a second separately actuatable mechanical contact in the second main current branch between the second winding tap and the second vacuum switching tube;

a third separately actuatable mechanical contact in the first auxiliary current branch between the first winding tap and the third vacuum switching tube;

a fourth separately actuatable mechanical contact in the second auxiliary current branch between the second winding tap and the fourth vacuum switching tube, whereby the vacuum switching tubes in the main current branch and the vacuum switching tubes in the auxiliary current branch of the unconnected winding tap are electrically separable from the unconnected tap, the mechanical contacts being double-pole changeover contacts.

* * * * *